US005921906A

United States Patent [19]

Nagano

[11] Patent Number: 5,921,906

[45] Date of Patent: Jul. 13, 1999

[54] PINLESS FOLDER

[75] Inventor: Hiroyuki Nagano, Higashikatsushika-gun, Japan

[73] Assignee: Komori Corporation, Tokyo, Japan

[21] Appl. No.: 08/935,858

[22] Filed: Sep. 23, 1997

[30] Foreign Application Priority Data

Oct. 15, 1996 [JP] Japan ..... 8-271932

[51] Int. Cl.[6] ..... B31B 1/14; B31F 1/08

[52] U.S. Cl. ..... 493/353; 493/359; 493/428; 493/429

[58] Field of Search ..... 493/426, 427, 493/428, 370, 353, 359

[56] References Cited

U.S. PATENT DOCUMENTS

| | | | |
|---|---|---|---|
| 792,557 | 6/1905 | Seymour | 493/428 |
| 3,727,909 | 4/1973 | Greiner et al. | 493/428 |
| 4,957,280 | 9/1990 | Motooka . | |
| 5,230,268 | 7/1993 | Richter . | |
| 5,494,270 | 2/1996 | Laubscher | 493/429 |

FOREIGN PATENT DOCUMENTS

| | | |
|---|---|---|
| 0338260 A2 | 10/1989 | European Pat. Off. . |
| 761705 | 3/1995 | Japan . |

*Primary Examiner*—John Sipos
*Assistant Examiner*—Steven Jensen

[57] ABSTRACT

A pinless folder has a hold-down blade in a cut-off cylinder having, together with paper presses, a cut-off knife capable of cutting a web a in its entire width. A folding cylinder contiguous to the cut-off cylinder is provided, in addition to a cutter pad and a gripping jaw, with a gripper board for holding the front end of the web a held down by the hold-down blade. The web a passing between the cut-off cylinder and the folding cylinder is cut in one operation at an even speed. The even-speed, one-stage cutting results in improved quality and a reduced number of component parts.

8 Claims, 6 Drawing Sheets

PINLESS FOLDER

BACKGROUND OF THE INVENTION

This invention relates to a pinless folder for a web offset printing press.

A pinless folder for a web offset printing press as shown in FIGS. 6 and 7 is known. In FIG. 6, the numeral 1 denotes a former. A web a folded in two by the former 1 (or an unfolded web b) is fed between a pair of first nipping rollers 2 and then between a pair of second nipping rollers 3. These nipping rollers rotate at the same peripheral speed as the travel speed of the web a. Then, the web a is fed to, and cut by, a cutting apparatus comprising a cutter cylinder 4 and a cutter bearing cylinder 5.

The cut paper (or signature) is rapidly speeded up by a pair of speedup transport belts 6, 6' guided by a pair of guide rollers 15, 15' to increase the distance between the trailing edge of a preceding sheet and the front end 18 of a succeeding sheet, and form a space S therebetween (see FIG. 7). Thus, the front end 18 of the succeeding sheet is gripped by grippers 8 of a folding cylinder 7 without undergoing interference by the trailing edge of the preceding sheet.

A middle part of the gripped succeeding sheet is pushed between a gripper board and a gripper pad of a gripping device 11 of a jaw cylinder 10 by a folding blade 9 of the folding cylinder 7 speeded up to the same peripheral speed as that of the speedup transport belts 6, 6'. As a result, the succeeding sheet is folded in two. The so folded succeeding sheet is then fed to a transport belt 12, a delivery fan wheel 13, and a delivery conveyor 14 in this order, and transported to the outside of the folder.

The above-described pinless folder poses the following problems:

(1) After the web a is cut, the cut sheet is rapidly increased in speed (by about 15–40%) to a level higher than the travel speed of the web a. Thus, a sheet end bend is apt to occur, especially, at both ends of the sheet which lie off the edges of the speedup transport belts 6, 6'. Furthermore, the sheet tends to incline, causing a disorder such as poor folding accuracy.

(2) The web a, sandwiched between the speedup transport belts 6, 6' and caused to slide while traveling, is suddenly fed (increased in speed) after trailing edge cutting. Thus, the front end position of the sheet fluctuates. It becomes difficult for the front end of the sheet to enter a predetermined grip position of the gripper 8. In this respect as well, folding accuracy is low.

(3) Before trailing edge cutting of the web a, the web a is caused to slide between the speedup transport belts 6, 6'. Thus, a printed pattern on the web a tends to be scratched by the belts.

(4) The web a is cut while being caused to slide between the speedup transport belts 6, 6'. After cutting, the sheet is transported while being sandwiched between the speedup transport belts 6, 6'. Thus, strict belt pressure adjustment is necessary. A lot of time and a high degree of skill are required for this task, lowering the operation rate of the folder.

(5) The web a is cut while being caused to slide between the speedup transport belts 6, 6'. Thus, static electricity tends to occur. If travel resistance due to static electricity is nonuniform in the width direction of the sheet, the sheet is twisted, and the fold is formed obliquely to the sheet end. Moreover, the posture and arrangement of sheets discharged to the delivery conveyor 14 are difficult to correct.

(6) The sheet guided by the speedup transport belts 6, 6' toward the folding cylinder 7 may be jammed between the speedup transport belts 6, 6'. Withdrawal of this sheet takes time. In this respect, too, the operation rate of the folder declines.

(7) The front end of the speeded up sheet is gripped by a plurality of grippers 8 arranged in a row in the sheet width direction of the folding cylinder 7 that has been speeded up to the speed of the sheet. Thus, bends tend to occur at both ends of the sheet lying off the grippers 8 positioned at both ends. A break can also happen owing to a buckle at the sheet end between adjacent grippers 8. Furthermore, the cut sheet is folded down the middle with the folding cylinder 7 and the jaw cylinder 10 being speeded up. Thus, the folding accuracy is prone to decline.

The foregoing phenomena (1) to (7) worsen as the folder operates at a higher speed.

A pinless folder as a solution to the above-described problems was proposed by Japanese Laid-Open Patent Publication No. 61705/95.

According to this pinless folder, as shown in FIG. 4, a web a folded in two by a former 1 is fed between a pair of first nipping rollers 2 and then between a pair of second nipping rollers 3. These nipping rollers rotate at the same peripheral speed as the travel speed of the web a. Then, the web a is fed between a first cutter cylinder 21 and a folding cylinder 23 so that interrupted cuts are formed in the web a in the paper width direction by a cutting apparatus comprising a cutter pad 34' of the folding cylinder 23 and saw blades 30 of the first cutter cylinder 21 [see FIG. 5(*a*)].

At this time, an around-the-cylinder transport belt 24 is moving in a circulating manner while contacting the outer peripheral surface of a lower part of the folding cylinder 23. Thus, the web a, interruptedly cut in the paper width direction, is sandwiched between the outer peripheral surface of the lower part of the folding cylinder 23 and the around-the-cylinder transport belt 24, and fed between a second cutter cylinder 26 and the folding cylinder 23. As a result, the remaining regions of the web a (the regions sandwiched between the respective thin belts of the around-the-cylinder transport belt 24) are cut in the paper width direction by a cutting apparatus comprising the cutter pad 34' of the folding cylinder 23 and saw blades 31 of the second cutter cylinder 26 [see FIG. 5(*b*)].

The front end of the web a, thus cut in the entire width, is pushed between grippers 32 attached to the folding cylinder 23 and gripper pads 33 attached to the folding cylinder 23 by a hold-down blade 28 of a front end hold-down cylinder 27 {the hold-down blade 28 notched at the front end in the paper width direction to avoid interference by the around-the-cylinder transport belt 24 [see FIG. 5(*c*)]}.

In the vicinity of the side surface of the gripper pads 33 of the folding cylinder 23, there is nothing which interferes with the above action. Thus, the front end of the web a can be pushed, without difficulty, into the folding cylinder 23. When this front end is pushed in, each hold-down blade 28, each gripper 32, and each gripper pad 33 are arranged linearly in the same row in the axial direction of the folding cylinder 23. The front end of the web a pushed between the grippers 32 and the gripper pads 33 is gripped while being bent in the radial direction.

The web a gripped by the folding cylinder 23 is further rotated and moved together with the folding cylinder 23. The rear end (trailing edge) of the web a is cut by the second cutter cylinder 26 to separate a signature. The middle of the separated signature is inserted into a gripping device 11 of a jaw cylinder 10 by a folding blade 29 of the folding cylinder 23. At this time, the grippers 32 of the folding cylinder 23 gripping the front end of the signature are opened to fold the signature in two parallel to the cut surface. Then, the signature is fed to a transport belt 12, a delivery fan wheel 13, and a delivery conveyor 14 in this order, and transported to the outside of the folder.

The above folder obviates the need to make the web a slide between speedup transport belts as done in the aforementioned speedup single-stage pinless folder. Thus, no printing troubles, such as belt scratches, are caused to a printed pattern on the web a. Furthermore, static electricity occurs minimally, folding accuracy can be improved, and the posture of the sheet discharged onto the delivery conveyor 14 can be easily corrected. Nor is it necessary to speed up the web a by speedup transport belts. Thus, the belt pressure need not be adjusted, paper jam can be made practically nonexistent, and the operation rate can be improved.

The above-mentioned conventional pinless folder, however, involves the following problems:

(1) A cutting step is performed twice (two-stage cutting). Thus, the cut surface is irregular [see FIG. 5(*d*)]. This can easily cause a paper jam in a subsequent step (delivery), and result in poor jogging in a stacker bundler.

(2) A phase adjustment mechanism may be constructed between the first and second cutting stages in order to avoid the irregularity of the cut surface. However, the adjustment of the cutting phase becomes necessary at the machine rise and the speedup, depending on a difference in the state of paper associated with the difference between low and high speeds, or a change in the movement of paper according to the change in the quality of paper. Thus, phase adjustment is tiresome and leads to much waste paper.

(3) Many component parts are involved, including the first cut-off cylinder, the second cut-off cylinder, and the front end hold-down cylinder. Thus, maintenance and management are tiresome, and the machine is upsized.

SUMMARY OF THE INVENTION

The object of the present invention is therefore to provide a pinless folder which can improve quality and cut down on component parts.

To attain the above object, a pinless folder concerned with the present invention comprises a hold-down blade in a first cylinder, and a gripper member for holding paper held down by the hold-down blade, the gripper member being provided in a second cylinder contiguous to the first cylinder, wherein paper press members are provided in the first and second cylinders, and a cut-off knife capable of cutting paper throughout its width is provided in one of the cylinders.

According to the above construction of the invention, paper fed between the first and second cylinders is completely cut in one operation. Immediately thereafter, the front end of succeeding paper is held by the gripper member, so that the succeeding paper is transported without its distance from the preceding paper being increased.

DETAILED DESCRIPTION OF THE PREFERRED EMBODIMENTS

A preferred embodiment of a pinless folder according to the present invention will now be described in detail by reference to the drawings.

Figure 1:
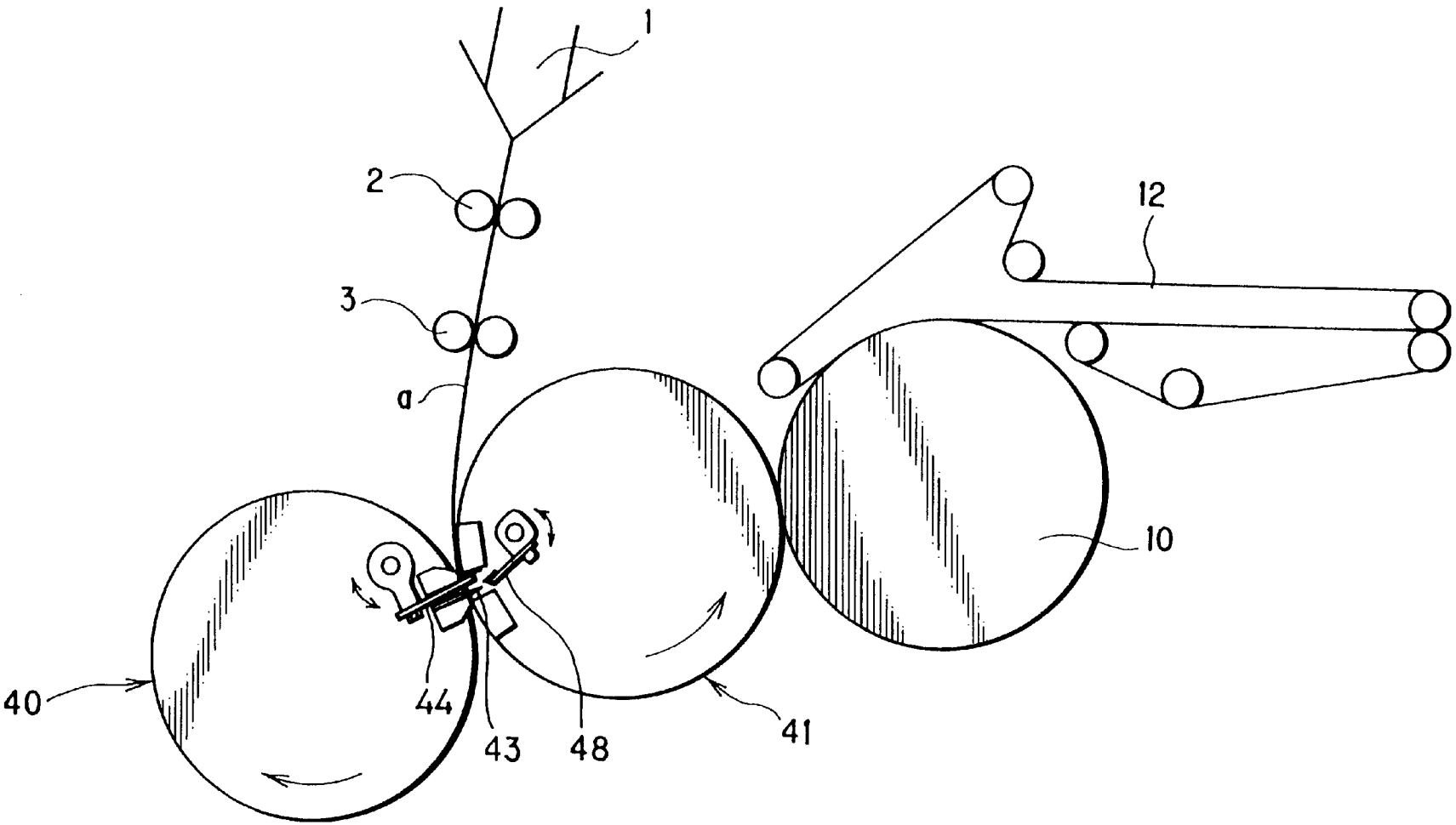
FIG. 1 is a schematic structural view showing an embodiment of a pinless holder concerned with the present invention.
Figure 2:
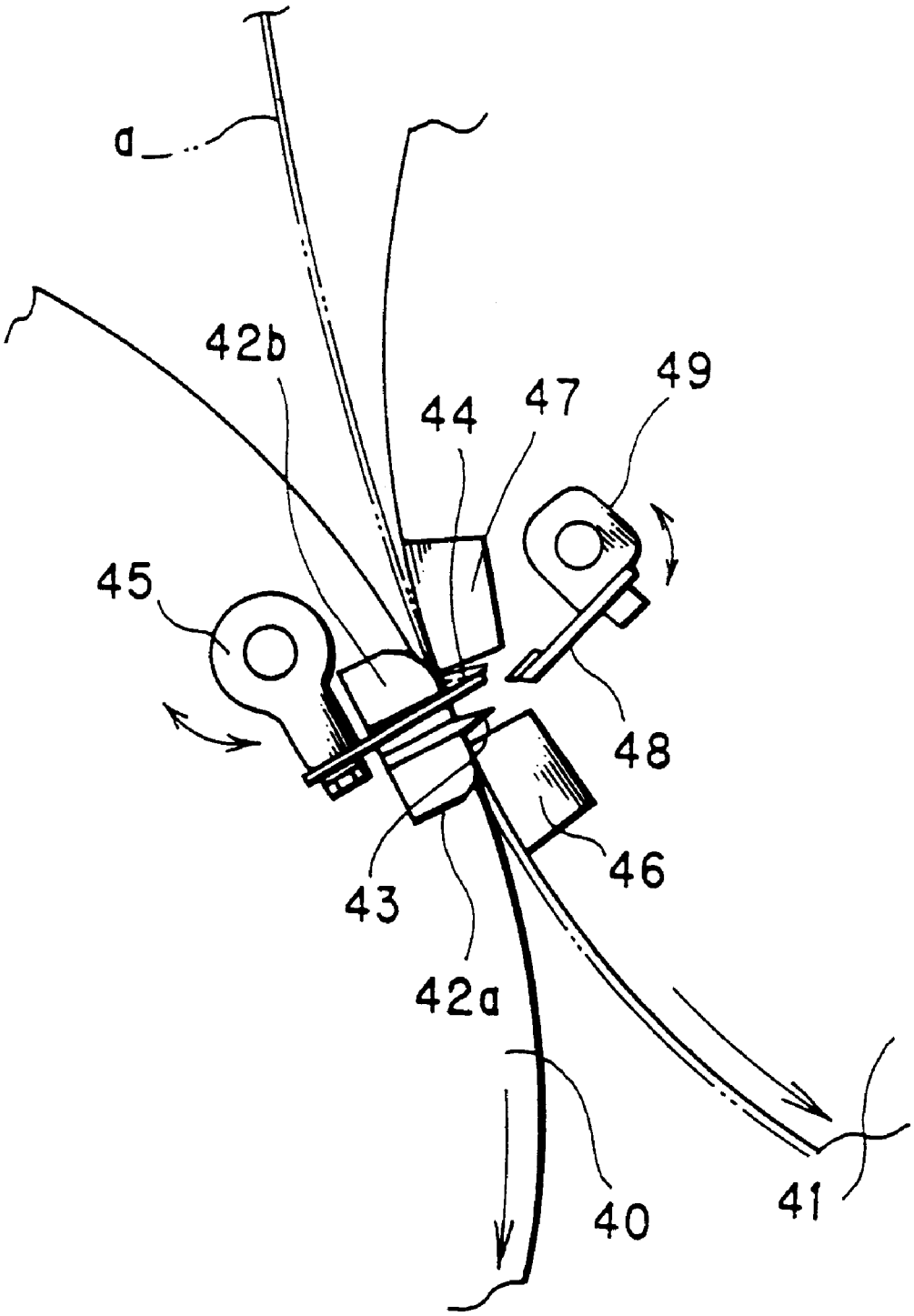
FIG. 2 is an enlarged view of an essential portion of the pinless holder.
Figure 3A:
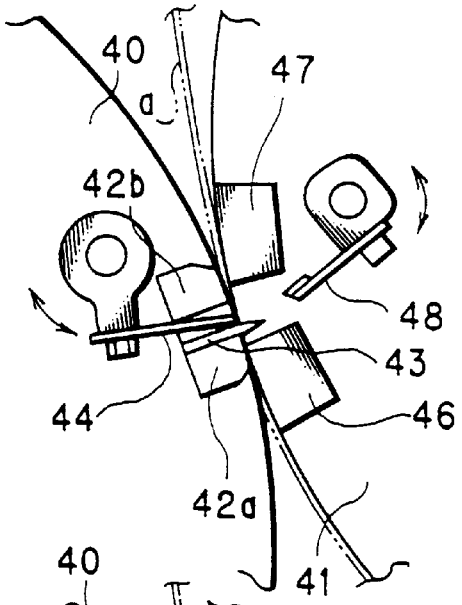
FIGS. 3(*a*)–3(*c*) are explanatory views of the actions of the pinless holder.
Figure 3B:
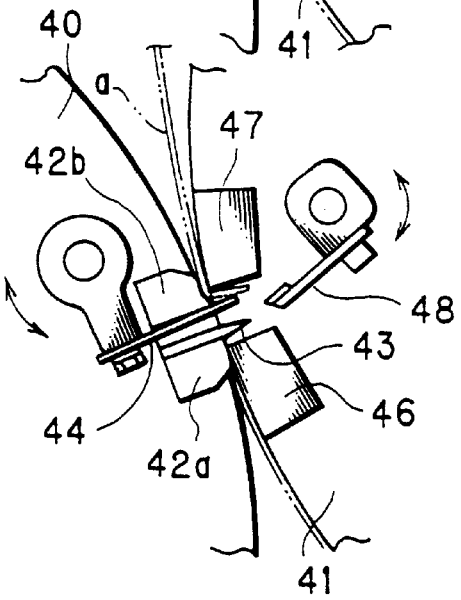
Figure 3C:
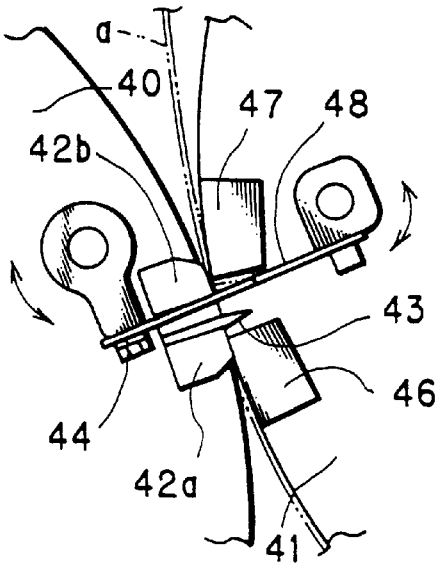
Figure 4:
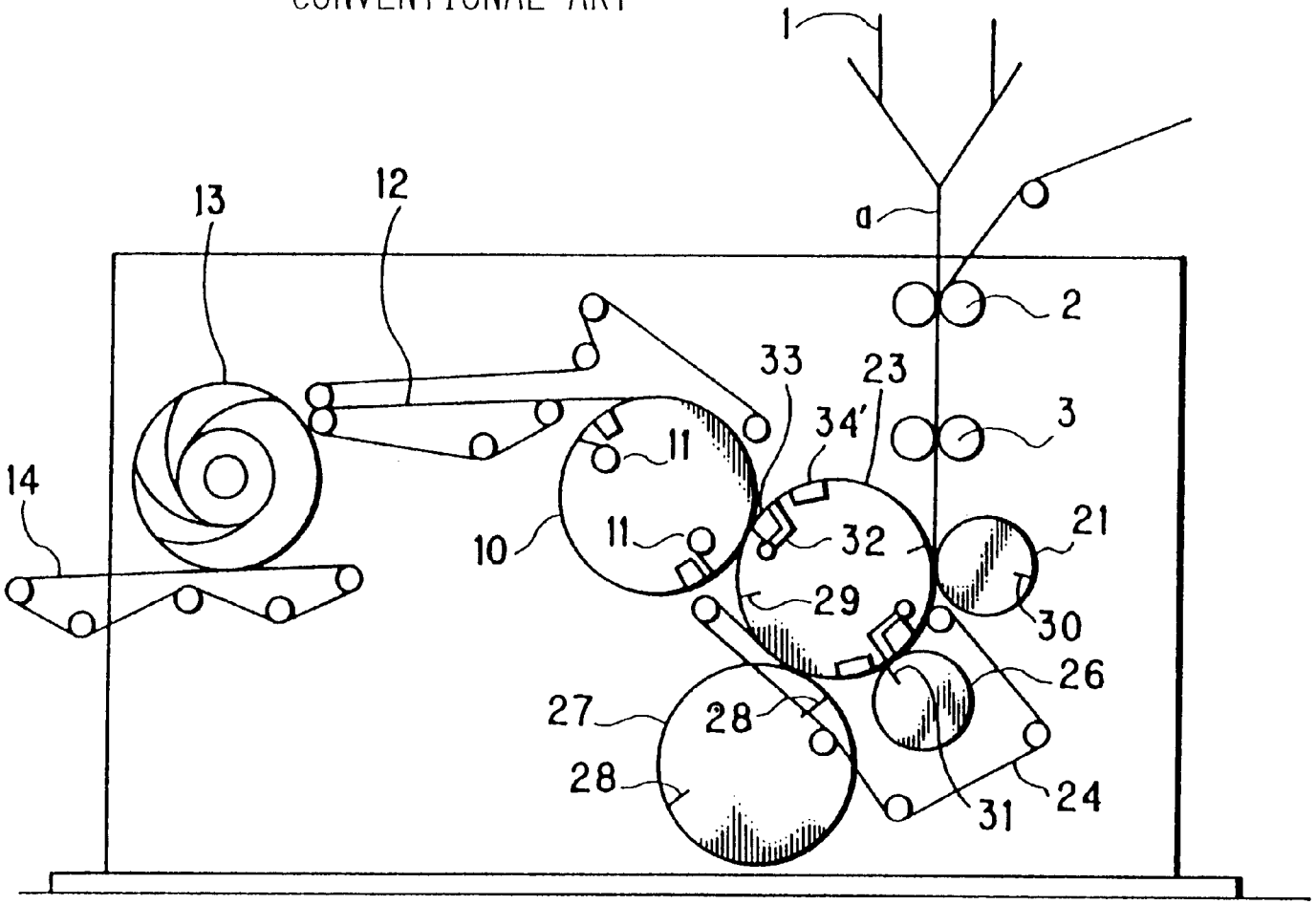
Fig.4 CONVENTIONAL ART
FIG. 4 is a schematic structural view of a conventional pinless holder.
Figure 5A:
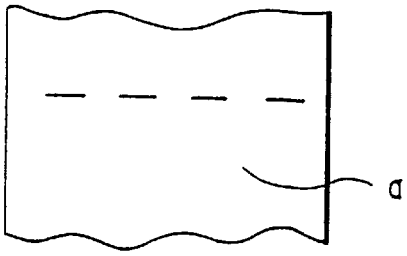
Fig.5(a) CONVENTIONAL ART
FIGS. 5(*a*)–5(*d*) are explanatory views showing the disadvantage of the conventional pinless holder.
Figure 5B:
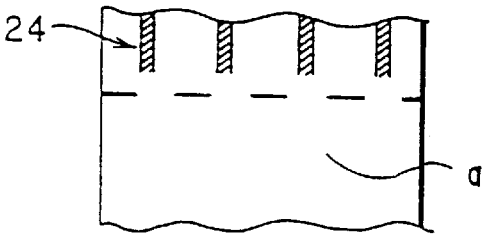
Fig.5(b) CONVENTIONAL ART
Figure 5C:
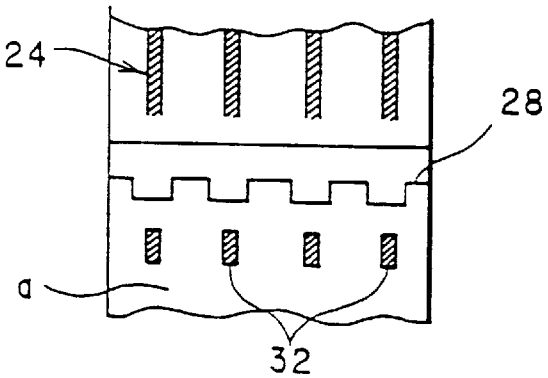
Fig.5(c) CONVENTIONAL ART
Figure 5D:
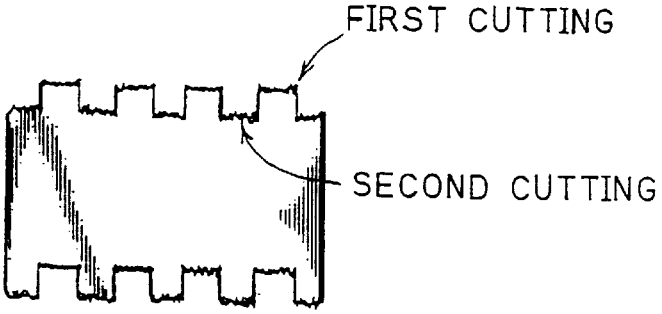
Fig.5(d) CONVENTIONAL ART
Figure 6:
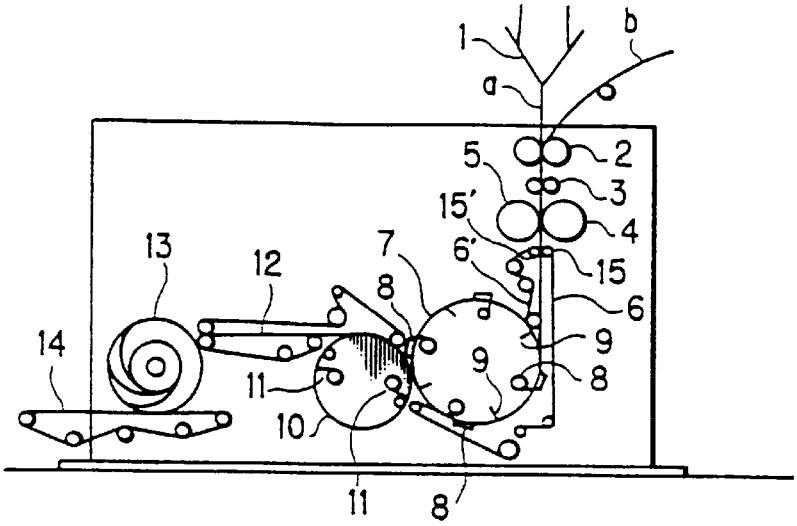
Fig.6 CONVENTIONAL ART
FIG. 6 is a schematic structural view of another conventional speedup single-stage pinless holder.
Figure 7:
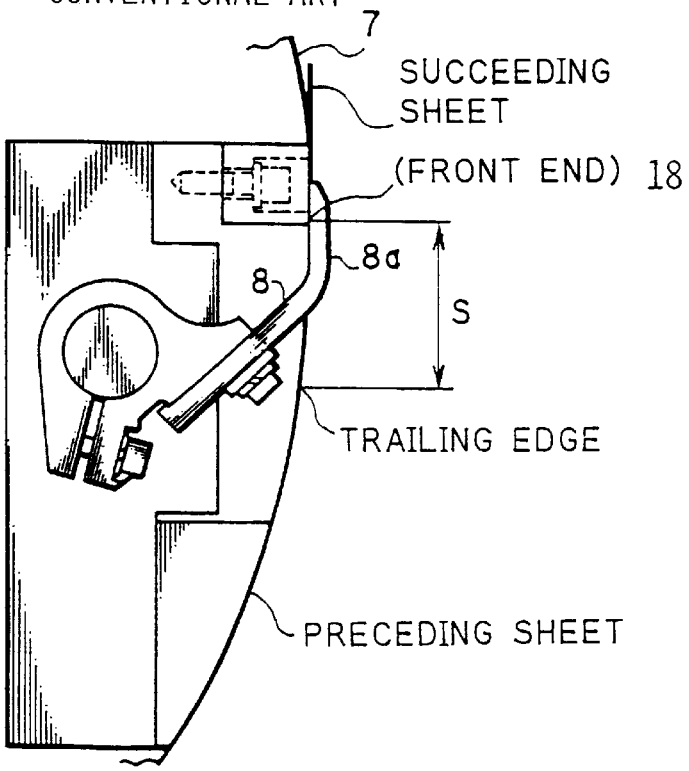
Fig.7 CONVENTIONAL ART
FIG. 7 is an enlarged view of an essential portion of the conventional speedup single-stage pinless holder.

FIG. 1 is a schematic structural view showing an embodiment of a pinless holder for a web offset printing press. FIG. 2 is an enlarged view of an essential portion of the pinless holder. FIGS. 3(*a*)–3(*c*) are explanatory views of the actions of the pinless holder. In these drawings, the same members, as those shown in FIG. 4, are assigned the same numerals, and overlapping explanations are omitted.

As shown in FIG. 1, a web a folded in two by a former 1 is fed between a pair of first nipping rollers 2 and then between a pair of second nipping rollers 3. These nipping rollers rotate at the same peripheral speed as the travel speed of the web a. Then, the web a is fed between a cut-off cylinder 40 and a folding cylinder 41, where the web a is cut in one operation.

A signature produced by cutting is parallel folded once by the folding cylinder 41 and a jaw cylinder 10 as in the customary practice. Then, the signature is fed to a delivery device outside the drawing by a transport belt 12.

The cut-off cylinder 40, as shown in FIG. 2, is fitted, on a part of its outer periphery, with a cutting apparatus comprising a pair of front and rear paper presses 42*a*, 42*b* and a cut-off knife 43. Between the paper presses 42*a* and 42*b*, a hold-down blade 44 is disposed, upstream of the cut-off knife 43 in the direction of rotation, for holding down the front end of the cut web a onto the folding cylinder 41.

The cut-off knife 43 is formed of a single blade capable of cutting the entire width of the web a. The hold-down blade 44 is supported via a support lever 45 to be pivotable between a bending position (holding down position) and a standby position.

To a part of the outer periphery of the folding cylinder 41, a cutter pad (concurrently functions as a paper press member) 46 and a gripping jaw 47 are secured such that the gripping jaw 47 is positioned upstream of the cutter pad 46 in the direction of rotation. Opposite the gripping jaw 47, a gripper board 48 lies which grips the front end of the web a held down by the hold-down blade 44. The gripper board 48 is supported by a support lever 49 to be pivotable between a gripping position and a standby position.

The hold-down blade 44 and the gripper board 48, as a gripper member, are arranged in a staggered manner in the paper width direction so that their front ends will not interfere with each other.

The actions of the pinless folder constructed as above will be described by reference to FIGS. 3(*a*)–3(*c*).

As shown in FIG. 3(*a*), the web a fed by the nipping rollers is brought between the cut-off cylinder 40 and the folding cylinder 41 which rotate at the same peripheral speed as the transport speed of the web a. As a result, the web a is cut in one operation by the single-blade cut-off knife 43 over the entire width of the web a. The rear end of a signature formed by cutting and the front end of the succeeding web a are held by the paper presses 42*a* and 42*b*, respectively.

Then, as shown in FIG. 3(*b*), the hold-down blade 44 pivots after the cutting, whereby the front end of the succeeding web a is pushed between the cutter pad 46 and the gripping jaw 47 of the folding cylinder 41.

Then, as shown in FIG. 3(*c*), the gripper board 48 pivots to close, gripping the front end of the succeeding web a in cooperation with the gripping jaw 47.

Afterwards, the web a is wound round the folding cylinder 41 to enter between the folding cylinder 41 and the jaw cylinder 10. There, the web a is parallel folded once as in the customary manner.

According to the instant embodiment described above, the web a is cut in one operation by the single-blade cut-off knife 43 over the entire width of the web a. Unlike the conventional two-stage cutting procedure, therefore, the cut surface is not irregular, and sheet jogging by a sheet stacker bundler in a subsequent step is satisfactory.

Furthermore, only one cut-off cylinder 40 is enough, and its combination with the hold-down blade 44 eliminates the conventional front end hold-down cylinder 27. Because of this decrease in the number of the component parts, the machine is easy to maintain and manage, and highly effective in terms of cost and space.

The present invention is not restricted to the above-described embodiment. The cut-off cylinder 40 in the embodiment may be constructed as a cutter bearing cylinder, while the cut-off knife 43 may be provided on the folding cylinder 41 side.

Instead of the three-cylinder system in the above embodiment, a two-cylinder system comprising a folding cylinder and a jaw cylinder may be constructed. The folding cylinder may have a gripper board, while the jaw cylinder may have a hold-down blade, and a cut-off knife may be provided in one of the folding cylinder and the jaw cylinder.

In the above embodiment, the hold-down blade 44 and the gripper board 48 are in a staggered arrangement in the paper width direction. However, they need not be arranged in a staggered shape, if the hold-down blade 44 is formed to such a short length as to prepare the way for holding down the front end of the web a, but not to interfere with the gripper board 48. Needless to say, there is no transport belt as in the conventional machine. Thus, the hold-down blade 44 and the gripper board 48 may each be composed of a single board.

As in the foregoing description, the pinless folder of the present invention comprises a hold-down blade in a first cylinder, and a gripper member for holding paper held down by the hold-down blade, the gripper member being provided in a second cylinder contiguous to the first cylinder, wherein the first and second cylinders are equipped with paper press members, and one of the cylinders is provided with a cut-off knife capable of cutting paper throughout its width. Thus, paper that has been fed between the first and second cylinders is cut in one operation at an even speed, leading to improved quality and a reduced number of component parts.

I claim:

1. A pinless folder, comprising:

a first cylinder;

a second cylinder provided adjacent said first cylinder;

paper press members, provided in said first and second cylinders, said paper press members including at least first and second members for holding at least first and second portions of the paper between said first and second cylinders, respectively;

a cut-off knife, provided in one of said first and second cylinders between the two portions, for cutting the entire width of the paper to form a leading end portion while said first member holds the first portion of the paper, and said second member holds the second portion of the paper immediately thereafter;

a hold-down blade, provided in said first cylinder, for holding the formed leading end portion against said second cylinder; and a gripper member, provided in said second cylinder, for holding the formed leading end portion against said second cylinder while said hold-down blade is holding the formed leading end portion against said second cylinder.

2. The pinless folder of claim 1, wherein the first cylinder and the second cylinder rotate at the same peripheral speed as the travel speed of the paper.

3. The pinless folder of claim 1, wherein the paper press members are provided, in a circumference of at least one of the first and second cylinders, with a paper press for pressing a trailing end of a preceding cut paper.

4. The pinless folder of claim 2, wherein the paper press members are provided, in a circumference of at least one of the first and second cylinders, with a paper press for pressing a trailing end of a preceding cut paper.

5. The pinless folder of claim 1, wherein said a cut-off knife is fixedly attached to said one of said first and second cylinders.

6. The pinless folder of claim 1, wherein the paper press members are provided, in a circumference of said first and second cylinders, with a paper press to press down a vicinity of the formed leading end portion of the cut paper.

7. A method of cutting a paper in a pinless web folder, comprising:

providing paper press members on first and second cylinders;

holding a paper between first and second cylinders in at least two portions by the paper press members;

cutting the entire width of the paper between the two portions to form a leading end portion;

holding the formed leading end portion of the cut paper against the first cylinder by a hold-down blade provided on a second cylinder;

holding the formed leading end portion of the cut paper against the first cylinder by a gripper member provided on the first cylinder while the hold-down blade is still holding the formed leading end portion; and releasing the hold-down blade from holding the formed leading end portion.

8. The method of claim 7, wherein said step of holding the formed leading end portion of the cut paper against the first cylinder by a hold-down blade includes the sub-step of, folding the formed leading end portion of the cut paper towards the first cylinder by the hold-down blade.

* * * * *